US009156076B2

(12) United States Patent
Figer et al.

(10) Patent No.: US 9,156,076 B2
(45) Date of Patent: Oct. 13, 2015

(54) DEVICE FOR THE DISPOSAL OF RESIDUAL WIRE

(75) Inventors: Ute Figer, Frohnleiten (AT); Walter Writzl, Graz (AT); Manfred Wöls, Etmissl (AT)

(73) Assignee: Andritz AG, Graz (AT)

( * ) Notice: Subject to any disclaimer, the term of this patent is extended or adjusted under 35 U.S.C. 154(b) by 1288 days.

(21) Appl. No.: 12/737,606

(22) PCT Filed: Jul. 24, 2009

(86) PCT No.: PCT/AT2009/000286

§ 371 (c)(1), (2), (4) Date: Mar. 22, 2011

(87) PCT Pub. No.: WO2010/012015

PCT Pub. Date: Feb. 4, 2010

(65) Prior Publication Data

US 2011/0162752 A1 Jul. 7, 2011

(30) Foreign Application Priority Data

Jul. 31, 2008 (AT) ..... A 1188/2008

(51) Int. Cl.

| | |
|---|---|
| ***B21F 3/02*** | (2006.01) |
| ***B21F 99/00*** | (2009.01) |
| ***B21B 13/18*** | (2006.01) |
| *B65B 13/18* | (2006.01) |

(52) U.S. Cl.
CPC . *B21F 3/02* (2013.01); *B21F 99/00* (2013.01); *B65B 13/18* (2013.01)

(58) Field of Classification Search
CPC ..... B21F 23/00; B21F 99/00; B21F 3/02; B65B 13/08
USPC ..... 72/133, 134, 135, 145, 146, 169, 447
See application file for complete search history.

(56) References Cited

U.S. PATENT DOCUMENTS

| | | | | |
|---|---|---|---|---|
| 3,315,509 | A | 4/1967 | Barlow | 72/145 |
| 4,578,977 | A * | 4/1986 | Murakami et al. | 72/135 |
| 5,361,618 | A * | 11/1994 | Stefanelli | 72/169 |
| 7,043,951 | B2 * | 5/2006 | Suzuki et al. | 72/134 |
| 7,080,537 | B2 * | 7/2006 | Tsuritani | 72/447 |
| 2004/0113009 | A1 | 6/2004 | Graeber et al. | 242/476.6 |

* cited by examiner

*Primary Examiner* — Teresa M Ekiert
(74) *Attorney, Agent, or Firm* — Alix, Yale & Ristas, LLP

(57) ABSTRACT

In order to simplify leftover wire (3) at the tying machines used in pulp production, a device is used that has an inlet guide (2) for the leftover wire (3) and a bending device (4) to bend the leftover wire running through continuously into a helical or spiral shape.

17 Claims, 3 Drawing Sheets

DEVICE FOR THE DISPOSAL OF RESIDUAL WIRE

Figure 1:
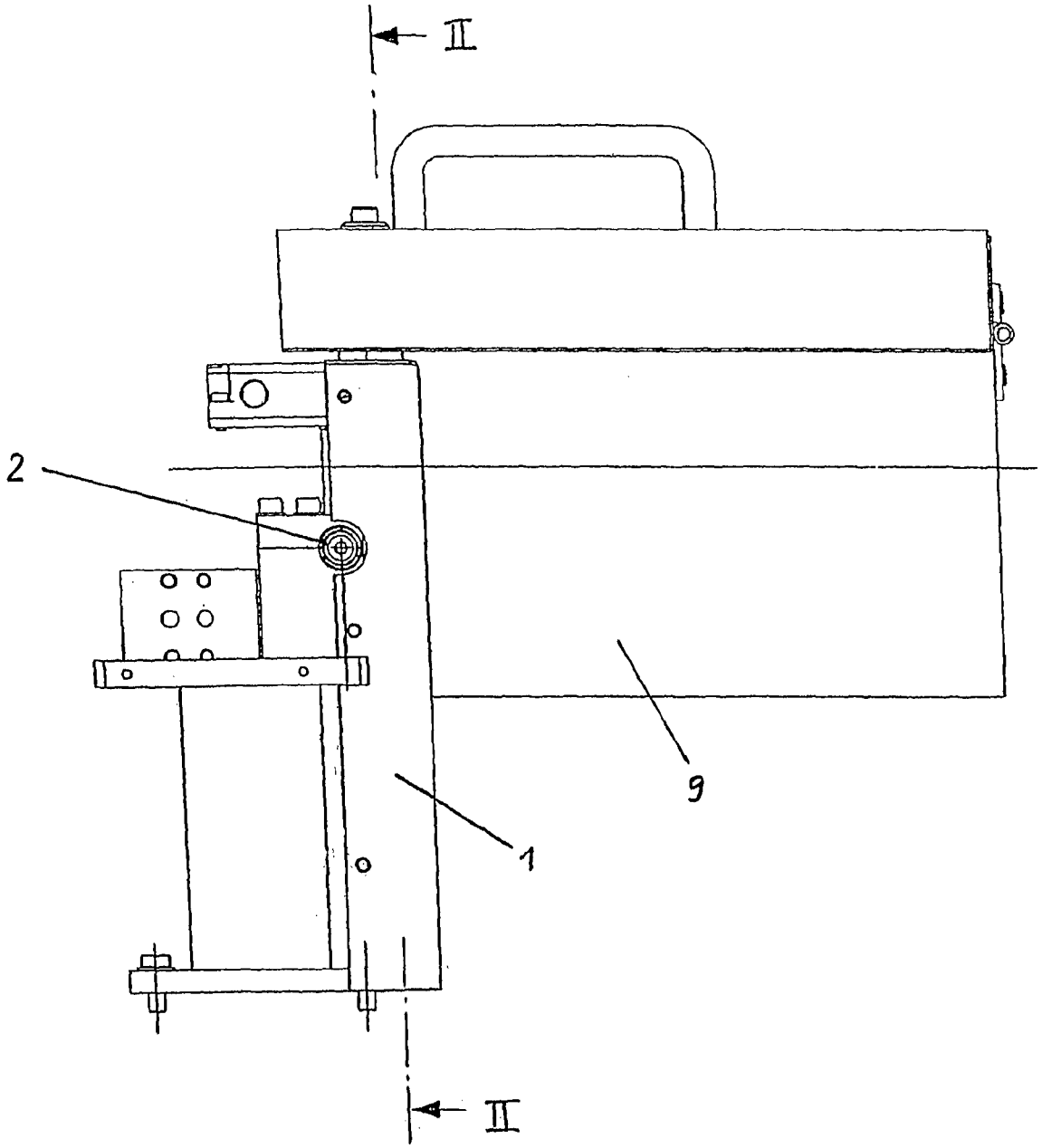

The invention relates to a device for disposing of leftover wire at tying machines.

Tying machines are used in pulp production in all finishing lines. Here, pulp bales, pulp bale stacks and/or pulp stack units are tied up using galvanized steel wire in a so-called tying frame of the tying machine. Up to now, the leftover wire that collects when the wire length available is not enough to tie up a bale completely is reversed out of the tying frame and disposed of by an operator.

The problem thus addressed by the present invention is to simplify disposal of the leftover wire.

The advantage of the device according to the invention is that there is no need for an operator to remove bulky leftover wire, thus saving on labour time on the one hand, and on storage space for the leftover wire on the other hand, because the wire can be wound up into a relatively small volume.

In a preferred embodiment of the invention, a collection container for the rolled up wire, which can be emptied as required, is provided directly adjacent to the device.

In a further preferred embodiment of the invention, the bending device can be moved from the idle position into a working position located in the trajectory of the leftover wire. Thus, in this embodiment the entire bending device is retracted out of the trajectory when it is not active. The tying wire can then run through the device unhindered. If, however, a leftover length of tying wire is to be disposed of, the bending device is moved into its operating position, where the leftover wire is bent into a helical or spiral shape.

In an alternative, but also preferred embodiment of the invention, the bending device has a bending element that can be moved from an idle position into a working position located in the trajectory of the leftover wire. Thus, in this embodiment it is not the entire bending device that is moved into a working or idle position, but only a bending element that bends the leftover wire.

The bending device preferably comprises at least two, preferably three rolls between which the leftover wire is fed during the bending process. Here, one of these rolls can form the bending element.

In connection with this embodiment, where only the bending element and not the entire bending device is moved into the working position or idle position, respectively, the roll acting as bending element is moved into the working position.

In addition or as an alternative, the bending device can have a level or curved impingement surface for the leftover wire. This impingement surface can then be used either to bend the leftover wire or to complete bending thereof.

Further characteristic features and advantages of the present invention result from the following description of a preferred embodiment of the invention, referring to the drawings.

Figure 2:
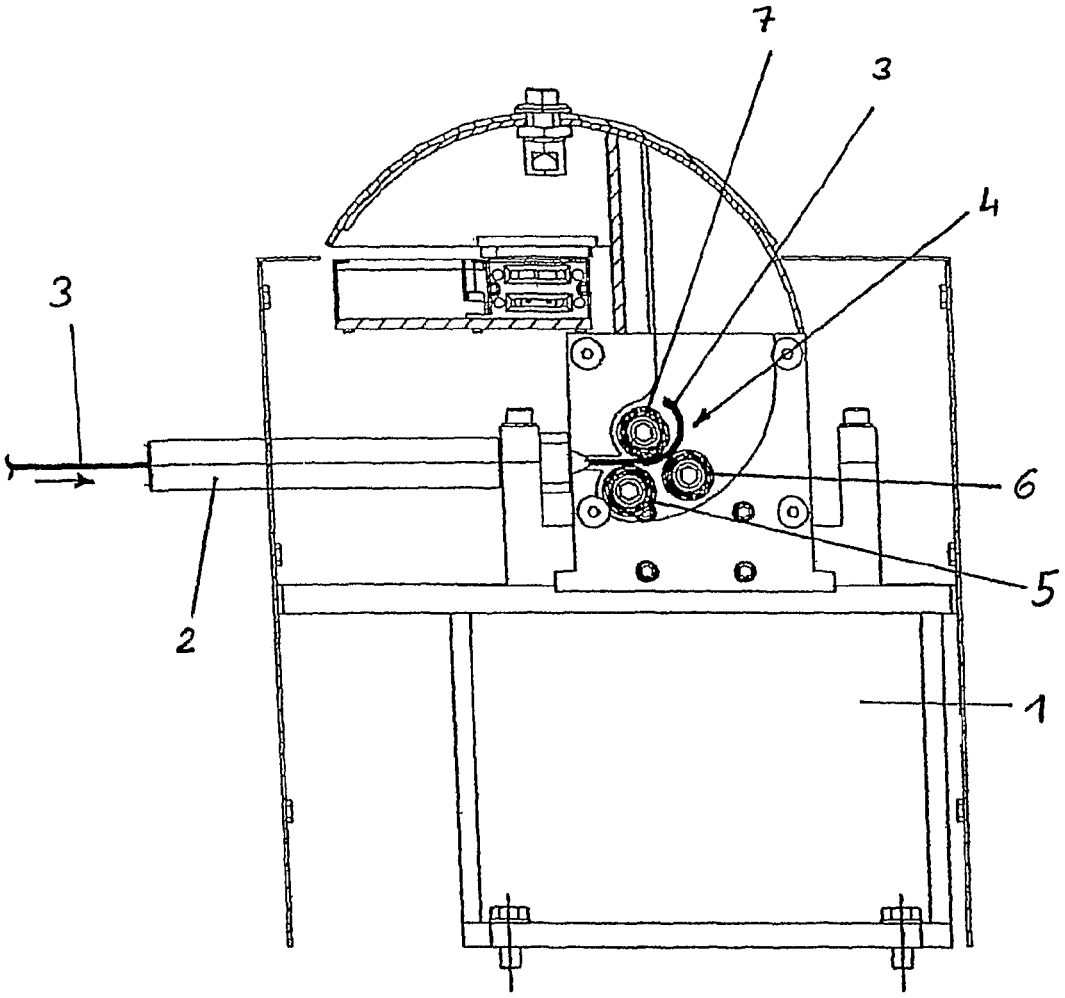
Figure 3:
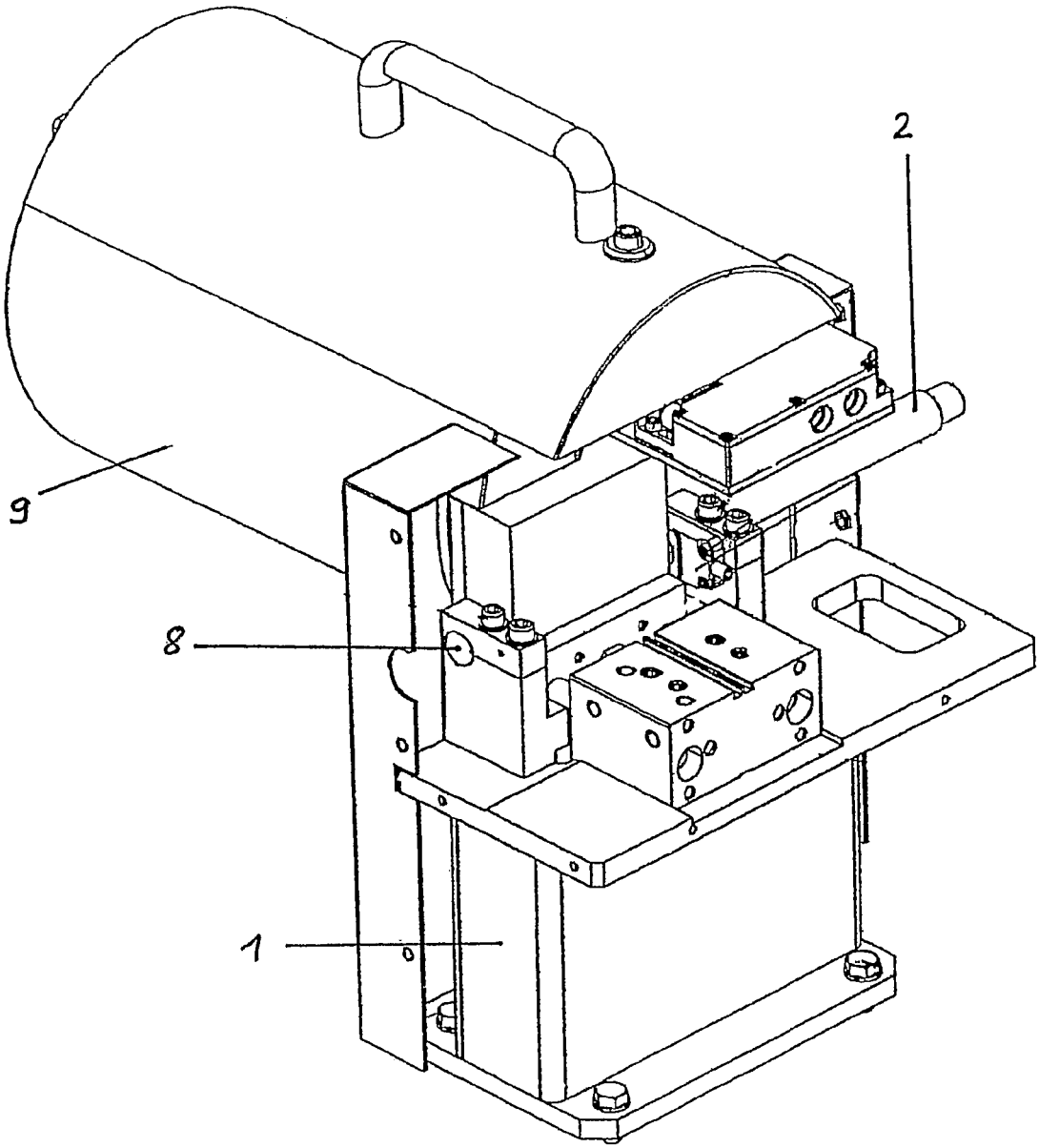

The drawings show:

FIG. 1 a vertical section of the device according to the invention, viewed in the running direction of the wire, FIG. 2 a sectional view of the device according to FIG. 1 through the line marked II, FIG. 3 a slanting view of this device.

The drawings show a device with a machine frame 1. On this machine frame 1 there is a tubular inlet guide 2 for a wire 3, which runs through unhindered when the tying machine is in normal operation, but can be coiled into a helical or spiral shape if necessary as leftover wire. This inlet guide 2 leads into a bending device 4, consisting of three rolls 5, 6, 7 in the embodiment shown.

This bending device 4 with the three rolls 5, 6, 7 is retracted into an idle position when it is not in operation, where the tying wire 3 used to tie up pulp bales, pulp bale stacks or pulp bale units can pass unhindered through the device according to the invention and exit through an outlet opening 8. If, however, there is no longer sufficient wire 3 available to tie up a pulp bale, for example, this leftover wire 3 is retracted to the extent that the leading end is resting in the inlet guide 2 and the bending device 4 can be moved unhindered into its working position. This can be effected with the aid of electric motors or a pressure medium drive, for example, using hydraulic or pneumatic cylinders. After this, the leftover wire 3 is pushed forward again in its original direction and then enters the gap between the two rolls 5 and 7, which act as guide rolls. Subsequently, the leftover wire 3 impinges onto roll 6, which acts as a bending element according to the invention and causes the leftover wire 3 that is guided in between rolls 5 and 7 to be bent upwards.

By providing suitable profiling on the rolls 5, 6 7 or, even better, by setting the roll 6 slightly on a slant, the leftover wire 3 can be deflected out of the bending plane a little and thus coiled in a helical shape.

Of course, it would also be possible in principle not to move the entire bending device 4 out of the working position into an idle position, but only to swing the roll 6, for example, downwards into an idle position because straight-line movement of the wire 3 used for tying is not hindered by rolls 5 and 7.

Finally, it would also be possible to move the entire device out of the trajectory of the wire 3 so that it runs past the device during normal operation of the tying machine. If a length of leftover wire 3 is to be rolled up, the machine is pushed into working position, the leftover wire 3 runs through a preferably funnel-shaped inlet guide 2 and is then rolled up as described.

Furthermore, it would also be possible in the invention to use a static bending element, for example in the form of a mounting with a level or curved impingement surface, for the leftover wire 3 instead of the roll 6, which is the active bending element. Within the scope of the invention it is possible in addition to locate an impingement surface of this kind immediately after the roll 6 in order to bend the leftover wire 3 further or control the way in which the wire is led out of the bending device 4.

At least one of the three rolls 5, 6, 7 can be driven so that the entire leftover wire 3 runs through the bending device 4 and is coiled without a further drive, or the driven roll 5, 6, or 7 is used to assist an existing drive. After this procedure the coiled leftover wire drops into a collection container 9 at the side beside the bending device 4. This collection container 9 must be emptied from time to time by the operating personnel, however this can be done very easily and with much longer intervals in between emptying because the leftover wire pieces are less cumbersome and their volume is small.

The invention claimed is:

1. Device for disposing of leftover wire (3) at tying machines, comprising:

an inlet guide (2) for tying wire (3) to be advanced along a straight running direction trajectory;

an outlet (8) longitudinally aligned to receive tying wire from the inlet guide along the trajectory for delivery of tying wire longitudinally from the device in a normal configuration;

a bending unit (4) situated between the inlet guide and the outlet, for continuous bending of a leftover portion of said tying wire away from the outlet into a substantially helical or spiral shape in a disposal configuration; and a collection container (9) for containing the shaped leftover portion of said wire (3);

wherein either the bending unit is moveable from an idle position outside the trajectory during the normal configuration into a working position located in the trajectory during the disposal configuration or the bending unit has a bending element (6) that is moveable from an idle position outside the trajectory during the normal configuration into a working position located in the trajectory during the disposal configuration.

2. Device according to claim 1, wherein the bending unit (4) has three rolls (5, 6, 7).

3. Device according to claim 2, wherein one of the rolls (6) forms the bending element.

4. Device according to claim 3, wherein at least two rolls (5, 7) are arranged as guide rolls ahead of the bending unit (4) in the running direction of the leftover wire (3).

5. Device according to claim 4, wherein the axis of rotation of at least one roll (6) is on a slant to the axis of rotation of at least one other roll (5, 7).

6. Device according to claim 5, wherein at least one of the rolls (5, 6, 7) is driven.

7. Device according to claim 6, wherein the bending unit (4) has a level or a curved impingement surface for the leftover wire (3).

8. Device according to claim 1, wherein the bending unit (4) has three rolls (5, 6, 7).

9. Device according to claim 1, including said tying wire, wherein the guide is tubular and wire is present in the guide during both the normal configuration and the disposal configuration;

in the normal configuration, the wire passes from the guide in a straight trajectory through the outlet while the bending unit is in said idle position without bending the wire;

in the disposal configuration, the leftover wire portion passes from the guide through the bending unit where the leftover wire portion is deflected transversely relative to the straight trajectory and forms said shape away from the outlet.

10. Device according to claim 9, including a collection container (9) where the shaped leftover wire portion (3) is contained.

11. Device according to claim 10, wherein the straight trajectory is horizontal and in the disposal configuration the wire is bent upwardly into the container.

12. Device for disposing of leftover wire (3) at tying machines, comprising:

an inlet guide (2) for tying wire (3) to be advanced along a straight running direction trajectory;

an outlet (8) longitudinally aligned to receive tying wire from the inlet guide along the trajectory for delivery of tying wire longitudinally from the device in a normal configuration; and a bending unit (4) situated between the inlet guide and the outlet, for continuous bending of a leftover portion of said tying wire away from the outlet into a substantially helical or spiral shape in a disposal configuration;

wherein the bending unit (4) has at least two rolls (5, 6, 7) and is moveable from an idle position outside the trajectory during the normal configuration into a working position located in the trajectory during the disposal configuration or the bending unit has a bending element (6) that is moveable from an idle position outside the trajectory during the normal configuration into a working position located in the trajectory during the disposal configuration.

13. Device according to claim 12, wherein one of the rolls (6) forms the bending element.

14. Device according to claim 12, wherein at least two rolls (5, 7) are arranged as guide rolls ahead of the bending unit (4) in the running direction of the leftover wire (3).

15. Device according to claim 12, wherein the axis of rotation of at least one roll (6) is on a slant to the axis of rotation of at least one other roll (5, 7).

16. Device according to claim 12, wherein at least one of the rolls (5, 6, 7) is driven.

17. Device for disposing of leftover wire (3) at tying machines, comprising:

an inlet guide (2) for tying wire (3) to be advanced along a straight running direction trajectory;

an outlet (8) longitudinally aligned to receive tying wire from the inlet guide along the trajectory for delivery of tying wire longitudinally from the device in a normal configuration; and a bending unit (4) situated between the inlet guide and the outlet, for continuous bending of a leftover portion of said tying wire away from the outlet into a substantially helical or spiral shape in a disposal configuration;

wherein the bending unit (4) has a level or a curved impingement surface for the leftover wire (3) and is moveable from an idle position outside the trajectory during the normal configuration into a working position located in the trajectory during the disposal configuration or the bending unit has a bending element (6) that is moveable from an idle position outside the trajectory during the normal configuration into a working position located in the trajectory during the disposal configuration.

* * * * *